US007913770B2

(12) United States Patent
Schramm et al.

(10) Patent No.: US 7,913,770 B2
(45) Date of Patent: Mar. 29, 2011

(54) CONTROLLED PRESSURE EQUALIZATION OF ATMOSPHERIC CHAMBERS

(75) Inventors: Robert D. Schramm, League City, TX (US); Marcus A. Avant, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 222 days.

(21) Appl. No.: 12/164,536

(22) Filed: Jun. 30, 2008

(65) Prior Publication Data

US 2009/0321081 A1 Dec. 31, 2009

(51) Int. Cl.
*E21B 33/12* (2006.01)
*E21B 34/06* (2006.01)

(52) U.S. Cl. ..... 166/387; 166/185; 166/332.7

(58) Field of Classification Search ..... 166/387, 166/185, 332.7

See application file for complete search history.

(56) References Cited

U.S. PATENT DOCUMENTS 3,719,241 A * 3/1973 Bell ..... 75/228
3,866,695 A * 2/1975 Jackson ..... 175/228
4,448,254 A * 5/1984 Barrington ..... 166/373
5,109,925 A * 5/1992 Stepp et al. ..... 166/184
5,992,520 A * 11/1999 Schultz et al. ..... 166/264
6,073,698 A * 6/2000 Schultz et al. ..... 166/317
6,186,227 B1 * 2/2001 Vaynshteyn et al. ..... 166/120
6,315,050 B2 * 11/2001 Vaynshteyn et al. ..... 166/376
6,474,419 B2 * 11/2002 Maier et al. ..... 166/387
6,516,886 B2 * 2/2003 Patel ..... 166/313
6,564,876 B2 * 5/2003 Vaynshteyn et al. ..... 166/387
6,945,331 B2 * 9/2005 Patel ..... 166/386
6,983,803 B2 * 1/2006 Watson et al. ..... 166/374
7,533,727 B2 * 5/2009 Barton et al. ..... 166/317
2001/0015277 A1 * 8/2001 Vaynshteyn et al. ..... 166/387
2001/0030049 A1 * 10/2001 Patel ..... 166/386
2002/0062962 A1 * 5/2002 Gary et al. ..... 166/305.1
2008/0271883 A1 * 11/2008 Barton et al. ..... 166/85.1
2009/0223675 A1 * 9/2009 Li et al. ..... 166/375
2009/0294137 A1 * 12/2009 Meijer ..... 166/387
2009/0321081 A1 * 12/2009 Schramm et al. ..... 166/370

* cited by examiner

*Primary Examiner* — Jennifer H Gay
(74) *Attorney, Agent, or Firm* — Shawn Hunter

(57) ABSTRACT

Methods and devices for equalizing an atmospheric chamber within a well tool in a controlled manner following the operation of setting the well tool. A packer setting tool has a setting mechanism with an atmospheric chamber and an equalization assembly to permit the pressure differential between the atmospheric chamber and the surrounding annulus to be substantially equalized.

14 Claims, 3 Drawing Sheets

CONTROLLED PRESSURE EQUALIZATION OF ATMOSPHERIC CHAMBERS

BACKGROUND OF THE INVENTION

1. Field of the Invention

The invention relates generally to downhole tools which incorporate one or more atmospheric chambers.

2. Description of the Related Art

A number of downhole tools rely upon the hydrostatic pressure of the wellbore in order to be actuated. These downhole tools include packers and locks that are set using hydrostatic pressure. Typically, such tools incorporate at least one collapsible atmospheric chamber into their setting mechanism. When the tool is constructed at the surface prior to being run into the well, the atmospheric chamber is usually enclosed and sealed off so that it contains an amount of fluid (usually air) at atmospheric pressure.

During setting of the tool, the atmospheric chamber is collapsed due to a pressure differential between the atmospheric chamber and surrounding hydrostatic and applied pressure within the wellbore. Following collapse, the atmospheric chamber continues to retain a small amount of fluid. A significant pressure differential between the atmospheric chamber and surrounding pressure is desirable to ensure positive actuation of the tool. The inventors have recognized, however, following actuation of the tool, a significant pressure differential can act to reduce the rating of the tool.

SUMMARY OF THE INVENTION

The invention provides methods and devices for equalizing an atmospheric chamber within a well tool in a controlled manner following the operation of setting the well tool. In a preferred embodiment, the well tool comprises a packer setting tool. In a currently preferred embodiment, a packer setting tool having a setting mechanism with an atmospheric chamber is provided with an equalization assembly to permit the pressure differential between the atmospheric chamber and the surrounding annulus to be substantially equalized. The equalization assembly includes a fluid passage that provides fluid communication between the atmospheric chamber and a setting chamber that is in fluid communication with the surrounding annulus. Preferably, entry of fluid into the setting chamber from the annulus is selectively blocked by a frangible rupture member. Preferably also, the fluid passage is provided with a fluid restrictor. One exemplary fluid restrictor is a porous plug member which is disposed within the fluid passage. In a preferred embodiment, the porous plug member is substantially formed of a sintered metal which provides interstices through which fluid may be communicated by seepage. During actuation of the setting tool, the rupture member is ruptured to permit fluid communication into the setting chamber from the surrounding annulus. This results in rapid compression of the atmospheric chamber. Thereafter fluid pressure between the atmospheric chamber and the surrounding annulus is substantially equalized in a controlled manner as fluid is communicated into the atmospheric chamber via the fluid passage. The equalization is controlled due to the flow restriction provided by the fluid restrictor. Equalization is delayed and occurs over an extended length of time, so that the setting process is not disrupted by rapid pressure equalization.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 2:
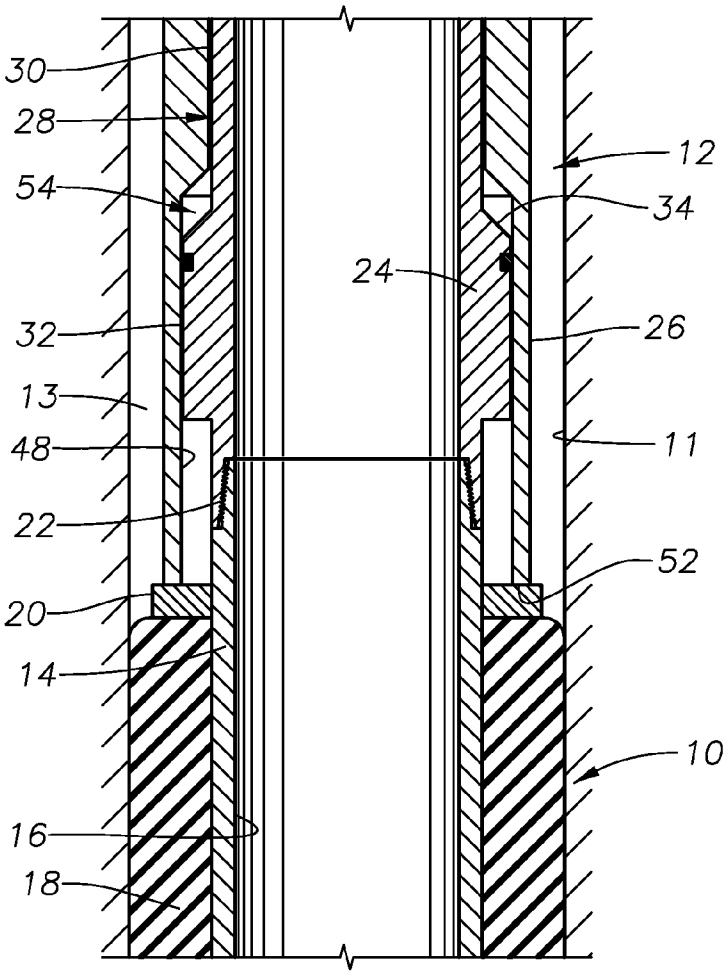
FIG. 2 is a side, cross-sectional view of the packer device and setting assembly, now with the packer device in a set condition.
Figure 1:
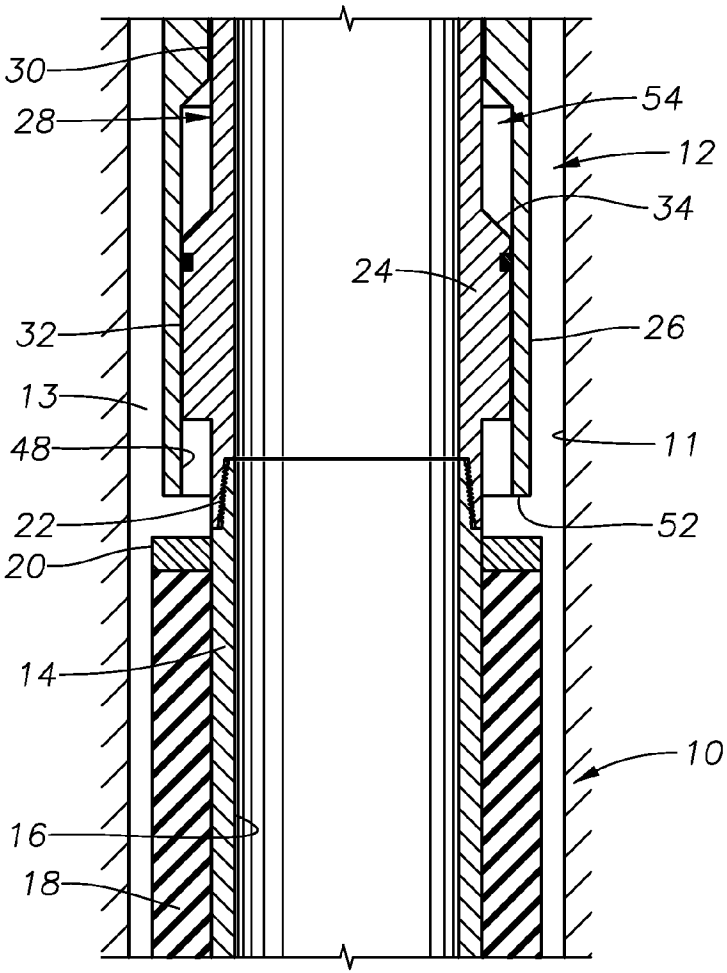
FIG. 1 is a side, cross-sectional view of an exemplary unset packer device and packer setting assembly constructed in accordance with the present invention.

FIG. 1 illustrates an exemplary packer device 10 and affixed hydraulic packer setting tool 12. Those of skill in the art will understand that the packer device 10 is used to form a fluid seal within a wellbore, the inner surface of which is indicated at 11, and that the setting tool 12 is used to set the packer within the wellbore 11. An annulus 13 is defined between the wellbore 13 and the packer device 10 and setting tool 12. As the annulus 13 contains wellbore fluids such as drilling mud and hydrocarbons, it is under hydrostatic pressure.

The packer device 10 includes a central packer mandrel 14 which defines a central axial bore 16. A compression-set packer element 18 radially surrounds the packer mandrel 14. The packer element 18 is preferably formed of an elastomeric material, although other suitable materials may be used. A setting collar 20 radially surrounds the packer mandrel 14 and abuts the packer element 18. The packer device 10 is affixed by threaded connection 22 to the setting tool 12.

Figure 3:
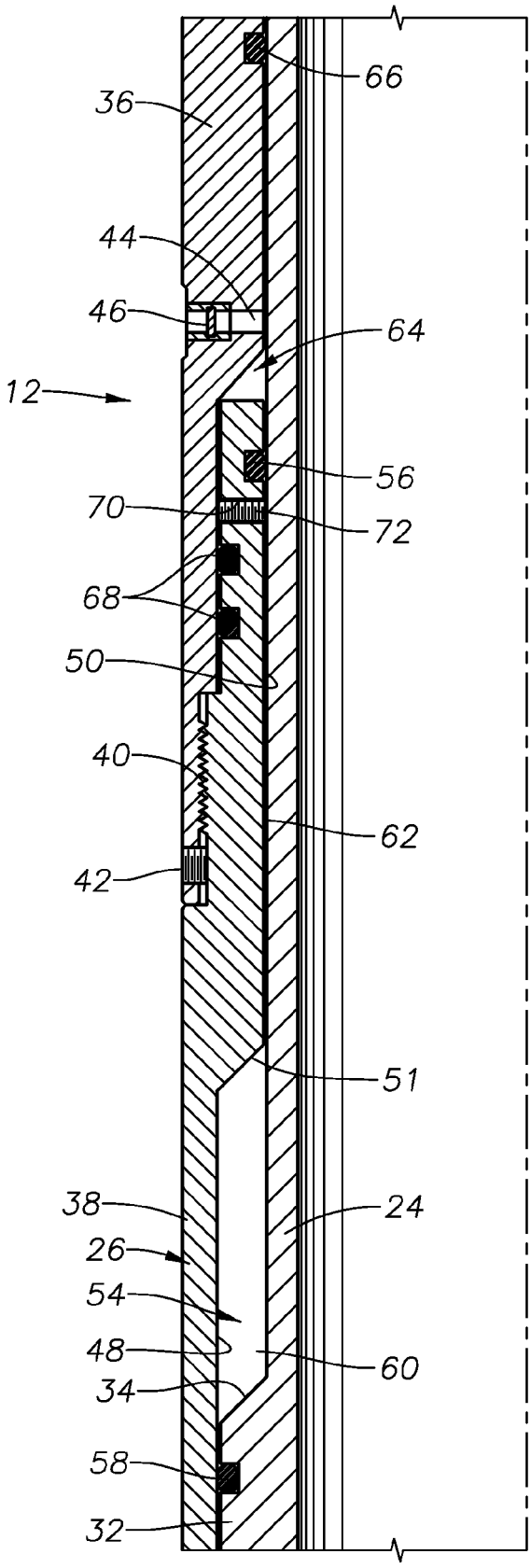
FIG. 3 is a side, one-quarter cross-sectional view of the atmospheric pressure chamber portion of the setting tool of FIGS. 1 and 2.
Figure 4:
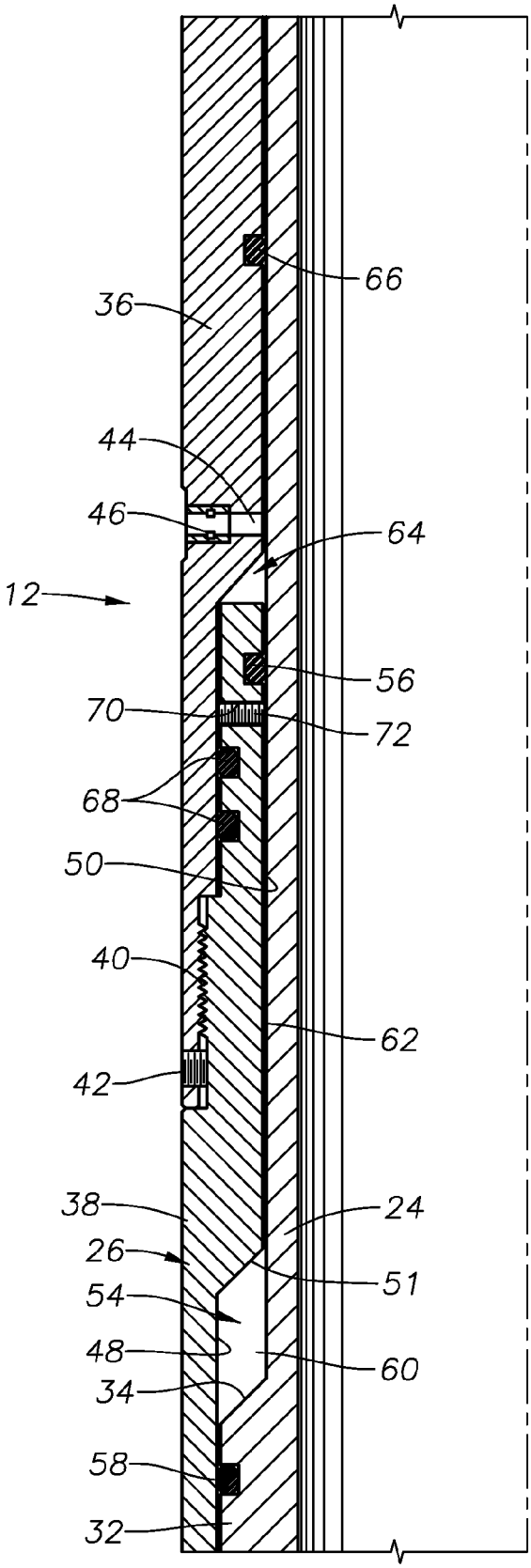
FIG. 4 is a side, one-quarter cross-sectional view of the atmospheric pressure chamber portion of the setting tool shown in FIG. 3 now in a collapsed condition.

The setting tool 12 includes a setting tool mandrel 24 and a radially-surrounding setting sleeve 26 which is axially moveable with respect to the setting tool mandrel 24. The outer radial surface 28 of the setting tool mandrel 24 includes a radially reduced portion 30 and a radially enlarged portion 32. A sloped shoulder 34 is defined between the radially enlarged portion 32 and the radially reduced portion 30. The setting sleeve 26 is better seen with further reference to FIGS. 3 and 4 and includes an upper sleeve section 36 and a lower sleeve section 38. The upper and lower sleeve sections 36, 38 are affixed to one another by threaded connection 40 and set screw 42. A fluid communication port 44 is disposed through the upper sleeve section 36 and is initially closed off by a frangible rupture member, such as rupture disc 46. The rupture disc 46 is selected to rupture at a predetermined pressure differential applied to the rupture disc 46, thereby selectively permitting fluid to flow through the port 44. The lower sleeve section 38 features a lower, enlarged-diameter interior portion 48 and a reduced-diameter interior portion 50 which are separated by sloped shoulder 51. The lower sleeve section 38 presents a compression end 52.

An atmospheric chamber 54 is defined radially between the setting tool mandrel 24 and the setting sleeve 26. It is noted that the use of the term "atmospheric chamber" herein, as it relates to the chamber 54, is not meant to be limited strictly to a chamber that is filled with a fluid that is maintained at one standard atmosphere of pressure. Instead, the terms "atmospheric chamber" and "atmospheric pressure" are meant to refer to a pressure that is markedly lower than the hydrostatic pressure that exists within the annulus 13. Thus, it is contemplated that the chamber 54 could be pressurized above a standard atmosphere or reduced in pressure below a standard atmosphere or placed into vacuum at the surface 14 prior to run in and still be encompassed within the term "atmospheric chamber," so long as a significant pressure differential between the chamber 54 and the hydrostatic pressure within the wellbore 10. The atmospheric chamber 54 is bounded at its upper axial end by annular fluid seal 56 and at its lower axial end by fluid seal 58. The atmospheric chamber 54 includes a collapsible volume portion 60 which is adjoined by annular space 62.

An annular setting chamber 64 is also defined radially between the setting tool mandrel 24 and the setting sleeve 26. The setting chamber 64 is bounded at its upper axial end by annular fluid seal 66 (visible in FIG. 4) and at its lower axial end by seal 56 and annular fluid seals 68. It is noted that the fluid communication port 44 interconnects the setting chamber 64 with the annulus 13.

Figure 5:
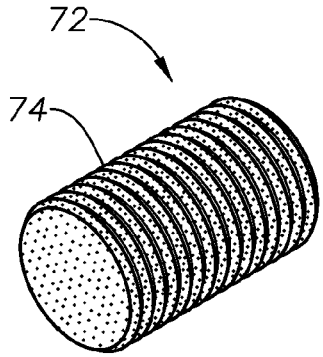
FIG. 5 depicts an exemplary porous plug member in accordance with the present invention.

A fluid passage 70 extends through the lower sleeve section 38 and interconnects the setting chamber 64 with the annular space 62 of the atmospheric chamber 54. A fluid restrictor is operably associated with the fluid passage 70. In a preferred embodiment, the fluid restrictor is a porous plug member 72 that is disposed within the fluid passage 70. In alternative embodiments, the porous plug member 72 may be located at one or both ends of the fluid passage 70 rather than within it. In a preferred embodiment, the plug member 72 is formed of a sintered metal which permits fluids to pass through the passage 70 slowly. A sintered metal provides interstices through which fluid may seep. FIG. 5 depicts an exemplary plug member 72. In a further preferred embodiment, the plug member 72 includes external radial threading 74 to permit it to be threadedly secured within the fluid passage 70.

In operation, the packer device 10 and setting tool 12 are assembled at the surface of a wellbore so that the atmospheric chamber 54 is filled with a fluid, such as air, at atmospheric pressure. The porous plug member 72 is disposed into the fluid passage 70, and then the upper setting sleeve section 36 is secured by threaded connection 40 to the lower setting sleeve section 38, which blocks fluid communication through the fluid passage 70 and ensures that the fluid within the atmospheric chamber 54 remains at atmospheric pressure. The set screw 42 is then inserted to further secure the upper and lower sections 36, 38 to one another. The packer device 10 and setting tool 12 are then disposed into the wellbore 11 in the unset condition depicted in FIGS. 1 and 3.

When it is desired to set the packer device 10 within the wellbore 11 the annulus is pressured up to a pressure level sufficient to cause the rupture disc 46 to be ruptured. High pressure fluid from the annulus 13 will enter the setting chamber 64 via the fluid communication port 44. The increased pressure in the annulus 13 will bear upon the upper end of the lower sleeve portion 38 and cause the setting sleeve 26 to shift with respect to the setting tool mandrel 24 as the collapsible chamber portion 60 of the atmospheric chamber 54 is collapsed. Movement of the setting sleeve 26 will cause the packer device 10 to be set as the compression end 52 of the setting sleeve 26 to contact the compression ring 20 and axially compress the packer element 18, in a manner known in the art.

Following setting of the packer device 10, the pressure differential between the now high-pressure annular setting chamber 64 and the low-pressure atmospheric chamber 54 will be equalized over an extended period of time. It is preferred that pressure equalization not occur immediately, as this might disrupt the operation of setting the packer device 10. Generally, a period of about five to ten minutes is desired to ensure that the packer device 10 becomes completely set although the particular amount of time will vary depending upon the particular packer device 10 and setting tool 12 being used. During the setting operation, it is important that the pressure differential between the atmospheric chamber 54 and the setting chamber 64 be maintained at a significant level. Following the setting process, wellbore fluid seeps through the porous plug member 72 and reduces the pressure differential. The amount of time for equalization to occur will vary depending upon the viscosity of the fluids present in the wellbore, the porosity of the plug member 72 and the degree of pressure differential. It is currently preferred that the porosity of the plug member 72 is such that the pressure differential between the atmospheric chamber 54 and the setting chamber 64 is maintained at about 80% or higher of the initial differential pressure level for around five to ten minutes following rupture of the rupture member 46. The fluid passage 70 and plug member 72 may be collectively considered an equalization assembly that permits controlled entry of fluid into the atmospheric chamber 54 and equalization of pressure between the atmospheric chamber 54 and the setting chamber 64 and surrounding annulus 13. The setting chamber 64, fluid communication port 44, and the rupture member 46 may be collectively considered to be an actuation mechanism that initiates both movement of the setting tool 12 from the unactuated position to the actuated position as well as the process of equalizing the pressure differential between the atmospheric chamber 54 and the well fluids within the surrounding setting chamber 64 and the annulus 13.

The foregoing description is directed to particular embodiments of the present invention for the purpose of illustration and explanation. It will be apparent, however to those skilled in the art that many modifications and changes to the embodiment set forth above are possible without departing from the scope and the spirit of the invention.

What is claimed is:

1. A well tool for use within a wellbore and moveable between an unactuated position and an actuated position, the well tool comprising:

a well tool housing defining an atmospheric chamber therein, the atmospheric chamber being collapsible by a wellbore fluid at a surrounding pressure from a first expanded volume to a second collapsed volume when the well tool is moved from the unactuated position to the actuated position;

an equalization assembly to substantially equalize the differential pressure between the atmospheric chamber and the surrounding pressure, the equalization assembly comprising:

a fluid passage to provide fluid communication between the atmospheric chamber and the wellbore fluid; and a fluid restrictor associated with the fluid passage to provide a controlled rate of fluid communication into the atmospheric chamber.

2. The well tool of claim 1 wherein the fluid restrictor comprises a porous plug member.

3. The well tool of claim 2 wherein the porous plug member is substantially comprised of sintered metal.

4. The well tool of claim 2 wherein the porous plug member is associated with the fluid passage by being disposed within the fluid passage.

5. The well tool of claim 4 wherein the porous plug member is secured within the fluid passage by threading.

6. The well tool of claim 1 wherein the well tool comprises a hydraulic packer setting tool.

7. The well tool of claim 6 wherein the well tool housing further comprises a setting sleeve.

8. The well tool of claim 7 further comprising an actuation mechanism to move the setting tool from the unactuated condition to the actuated condition, the actuation mechanism comprising:

an annular setting chamber radially surrounding the setting tool mandrel;

a fluid communication port disposed through the setting sleeve to permit fluid communication into the setting chamber from a surrounding wellbore annulus; and a frangible rupture member associated with the fluid communication port, the rupture member being rupturable at a predetermined pressure differential to selectively permit fluid communication through the fluid communication port.

9. A hydraulic packer setting tool for use in setting a packer in a wellbore, the tool comprising:

a setting tool mandrel;

a setting sleeve radially surrounding the setting tool mandrel and axially moveable with respect to the setting tool mandrel for setting of an affixed packer device;

an atmospheric chamber defined between the setting tool mandrel and the setting sleeve, the atmospheric chamber containing a fluid at a first pressure;

a setting chamber to contain wellbore fluid at a second pressure that is greater than the first pressure;

an equalization assembly comprising:

a fluid passage to provide fluid communication of wellbore fluid from the setting chamber to the atmospheric chamber; and a fluid restrictor operably associated with the fluid passage to restrict the rate of fluid flow into the atmospheric chamber, the fluid restrictor comprising a porous plug member.

10. The packer setting tool of claim 9 wherein the porous plug member is substantially formed of a sintered metal.

11. The packer setting tool of claim 9 wherein the porous plug member is secured within the fluid passage by threading.

12. The packer setting tool of claim 9 further comprising a fluid communication port disposed through the setting sleeve to permit fluid communication into the setting chamber from a surrounding wellbore annulus.

13. The packer setting tool of claim 12 further comprising a frangible rupture member associated with the fluid communication port, the rupture member being rupturable at a predetermined pressure differential to selectively permit fluid communication through the fluid communication port.

14. A method of substantially equalizing a pressure differential between a collapsible atmospheric chamber within a well tool and a wellbore fluid at a surrounding pressure comprising the steps of:

actuating the well tool to collapse the atmospheric chamber;

thereafter, flowing the fluid into the atmospheric chamber and seeping the fluid through a porous plug separating the atmospheric chamber from the wellbore fluid to substantially equalize the pressure differential.

* * * * *